US005502908A

United States Patent [19]

Powell et al.

[11] Patent Number: 5,502,908

[45] Date of Patent: Apr. 2, 1996

[54] ANIMATED DISPLAY

[75] Inventors: John Powell, Rolling Meadows; Marvin L. Adenau, Wadsworth; Thomas C. Tuten, Glenview, all of Ill.

[73] Assignee: Thomas A. Schutz Co., Inc., Morton Grove, Ill.

[21] Appl. No.: 209,548

[22] Filed: Mar. 10, 1994

[51] Int. Cl.[6] ..... G09F 19/00

[52] U.S. Cl. ..... 40/410; 40/409

[58] Field of Search ..... 40/410, 409, 439, 40/477; 472/65; 446/267, 176, 178, 179, 156, 159

[56] References Cited

U.S. PATENT DOCUMENTS

| | | | |
|---|---|---|---|
| 1,101,422 | 6/1914 | Fielding . | |
| 2,587,620 | 3/1952 | Hormann . | |
| 2,897,619 | 8/1959 | Zenz . | |
| 3,158,955 | 12/1964 | Sturgis . | |
| 3,243,183 | 3/1966 | Scranage . | |
| 4,190,312 | 2/1980 | Bailey | 40/410 X |
| 4,215,500 | 8/1980 | Sharp | 40/409 |
| 4,490,931 | 1/1985 | Fleemin | 40/409 X |
| 4,641,445 | 2/1987 | Rossi | 40/410 |
| 4,817,311 | 4/1989 | Ong | 40/410 |
| 4,961,276 | 10/1990 | Lin | 40/410 |
| 5,131,175 | 7/1992 | Liu | 40/410 |
| 5,200,239 | 4/1993 | Chen . | |

*Primary Examiner*—Kenneth J. Dorner
*Assistant Examiner*—Cassandra Davis
*Attorney, Agent, or Firm*—Wood, Phillips, VanSanten, Clark & Mortimer

[57] ABSTRACT

An animated display having a case defining an internal display chamber that is visible from externally of the case. A plurality of discrete particles are provided within the display chamber. Structure is provided on the case for propelling the discrete particles in a continuous circular path with the particles suspended in a fluid within the display chamber.

24 Claims, 2 Drawing Sheets

ANIMATED DISPLAY

BACKGROUND OF THE INVENTION

1. Field of the Invention

This invention relates to advertising displays, as used at point of purchase and, more particularly, to a display which uses animation to enhance its visual appeal.

2. Background Art

In the highly competitive advertising industry, designers strive to develop point of purchase advertising displays that are highly visually appealing. At the same time, the cost of these displays must be maintained within a reasonable range to allow periodic replacement, as when a company adopts a new advertising theme or wishes to prevent overexposure of the consumer to a particular display.

Conventional displays range from one dimensional, fixed displays to relatively elaborate, animated displays.

It is popular amongst some advertisers to associate their product with snow and/or ice. Simulated snowfall gives the consumer a sense that the product is cool and refreshing.

Heretofore, many advertising displays using simulated snowfall have been relatively passive in nature. U.S. Pat. Nos. 2,587,620 (Hormann) and 2,897,619 (Zens) both disclose such advertising displays.

Hormann circulates fingers through an accumulated supply of snow simulating flakes to cause the individual flakes to be elevated and deposited in front of a scene.

Zens continuously conveys simulated snow flakes to the top of a display and distributes the flakes so that they fall uniformly across the width in front of a display area.

U.S. Pat. Nos. 3,243,183 (Scranage) and 5,200,239 (Chen) both disclose systems for depositing artificial snow flakes from overhead upon a tree. Chen uses a recirculating arrangement.

Another known decorative object employs a sealed, partially clear case which contains a finite amount of liquid. A small scene and/or figure is mounted within the liquid. Discrete snow simulating particles are suspended in the liquid and have sufficient weight to fall under the force of gravity through the liquid. The user manually picks the case up and turns it upside down long enough to allow the particles to accumulate at the top of the case. By then righting the case, the particles float downwardly to simulate a shower of snow over the figure/scene.

In order for this type of system to be used in the advertising industry, the case would have to be turned upside down and righted at prescribed intervals. Thus it is relatively impractical to keep such a device "animated".

While the above structures can be employed to produce an attractive display, there are limitations built in to these displays by reason of the flakes moving downwardly principally under the force of gravity. That is, the snow simulating flakes flow relatively gently downwardly as snow would move under calm conditions.

SUMMARY OF THE INVENTION

In one form of the invention, an animated display is provided having a case defining an internal display chamber that is visible from externally of the case. A plurality of discrete particles are provided within the display chamber. Structure is provided on the case for propelling the discrete particles in a continuous circular path with the particles suspended in a fluid within the display chamber.

The circular path can extend around a vertically extending axis.

With the inventive structure, it is possible to develop a pattern of movement of the discrete particles to simulate severe weather conditions, such as a whirling snowstorm, within the display chamber.

The case has a wall that may be provided with a cylindrical inside surface that bounds the display chamber.

The structure for propelling the discrete particles may be constructed to produce a stream of fluid moving in a direction transverse to the vertically extending axis. This stream may be created by introducing a fluid under pressure or by a fan, or the like, on the display, which moves the fluid.

The structure for propelling the discrete particles includes an upwardly facing ramp surface on which discrete particles can accumulate as they fall by gravity through the display chamber. The ramp surface is inclined from the horizontal so that discrete particles moving along the ramp surface have a vertical velocity component.

An upper free edge can be provided on the ramp surface at which point the particles moving along the ramp surface separate from the ramp surface.

The structure for producing the stream of fluid can be arranged to cause the fluid to travel beneath and past the upper free edge of the ramp surface to intercept the travelling particles at that point.

To add another dimension to the flow of particles, a deflecting structure can be provided to intercept and redirect particles moving along the ramp surface. This deflecting structure can be provided where the particles separate from the ramp surface, or elsewhere. In one form, the deflecting surface has first and second formed fingers with a space therebetween to allow passage of fluid.

The movement of particles can be further enhanced by the provision of an additional structure for producing a separate stream of fluid. Additional ramp surfaces can also be provided.

The discrete particles can be made from a number of different materials. The particles can be made from cardboard and more preferably from plastic. In one form, expanded polystyrene is ground to produce the particles.

To reduce the tendency of the particles to adhere to the case, as when parts of the case and/or the particles are :made from plastic, structure is provided to reduce static electricity buildup on the display chamber.

In one form, the internal chamber is filled with air which can be continuously introduced into and exhausted from the display chamber as the display is operated.

In another form of the invention, an animated display is provided having a case defining a display chamber that is visible from externally of the case, a plurality of discrete particles within the display chamber, and structure on the case for propelling the discrete particles to move in a continuous path suspended in fluid in the display chamber.

An object can be provided within the display chamber in such a fashion that it appears that the object resides within a snowstorm.

To further enhance the appearance of the display, a simulated snow bank can be provided within the display chamber, with the object situated so that it appears as if the object is projecting from the snow bank.

The snow bank simulating structure can also be used to guide movement of the particles. In one form, the snow bank simulating structure defines a curved outer surface to guide circular movement of the particles.

Structure can be provided on the exterior of the case to simulate at least one of ice and snow to further enhance the appearance of the display.

DETAILED DESCRIPTION OF THE DRAWINGS

Figure 1:
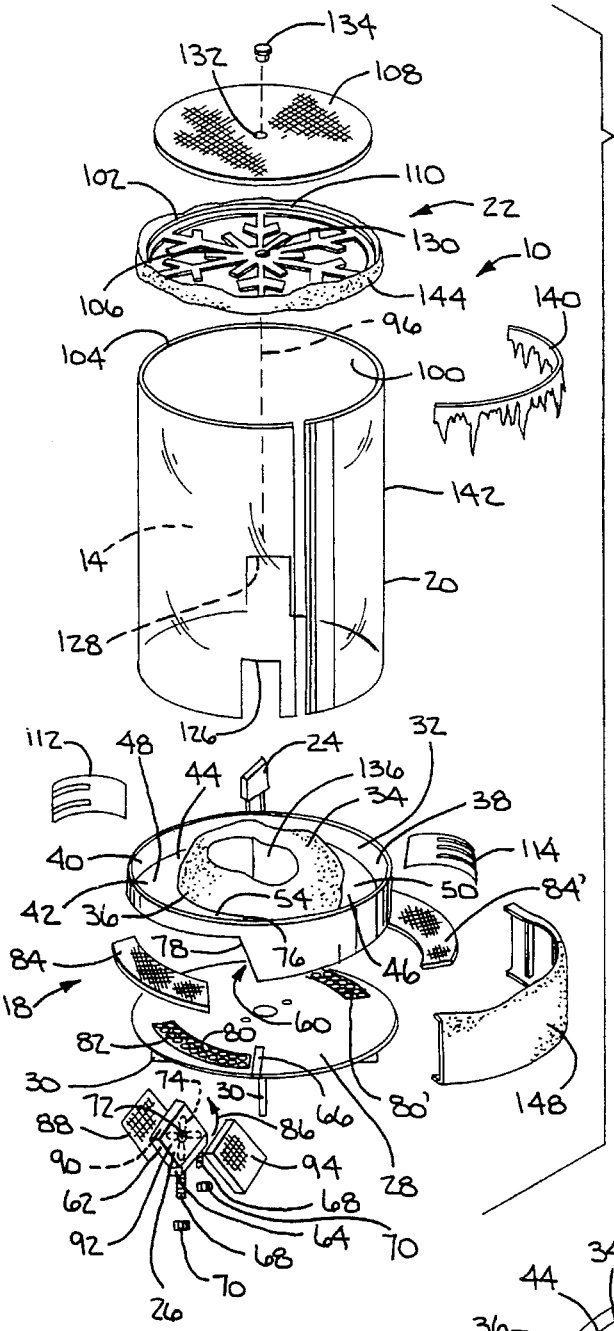
FIG. 1 is an exploded perspective view of a preferred form of animated display according to the present invention.

In FIGS. 1–4, a preferred form of animated display, according to the present invention, is shown at 10. The display 10 has a case 12 that defines an internal display chamber 14.

One objective of the present invention is to provide animation within the display chamber 14. In this case, the objective of the animation is to simulate a winter scene and, more particularly, a blizzard condition wherein discrete particles 16, simulating snow flakes, are propelled in such a fashion that they remain entrained in a fluid within the display chamber 14 and move at relatively high speeds to give the appearance of a swirling blizzard.

The case 12 consists of a base section 18, a viewing wall 20 and a cap section 22. The base section 18, viewing wall 20 and cap section 22 are all combined to produce an overall cylindrical configuration for the assembled display 10.

The base section 18, viewing wall 20, diametrically oppositely positioned axial fans 24, 26, and cap section 22 cooperatively define a means for propelling the discrete particles 16 within the chamber 14 in a continuous path in suspension in the fluid in the chamber 14. In a preferred form, the fluid in the chamber is air, though the inventive concept could be practiced with a liquid.

The base section 18 has a flat bottom wall 28 with depending supporting legs 30 on the underside thereof. The bottom wall 28 provides a foundation for a decorative guide section 32, which guide section 32 cooperates with the fans 24, 26 to elevate discrete particles 16 accumulated on the guide section 32 into a suspended state in the chamber 14.

The guide section 32 has a raised center section 34 which defines a generally cylindrical, outer guide surface 36. The guide surface 36 is concentric with a cylindrical surface 38 on an outer wall 40 on the guide section 32. The center section 34, outer wall 40, and bottom wall 42 on the guide section 32 cooperatively define an annular trough for the accumulation of discrete particles 16 that may fall by gravity through the chamber 14.

The bottom wall 42 is defined by two ramp sections 44, 46, each having an upwardly facing surface 48, 50 extending through approximately 180°. The ramp surface 48 has a bottom end 52 which spirals continuously upwardly to a top end 54. The ramp surface 50 is similarly constructed with a bottom end 56 adjacent to the top end 54 of the ramp surface 48, and a top end 58 adjacent to the bottom end 52 of the ramp surface 48. Resultingly, a step is defined at the transition between the top end 54 of the ramp surface 48 and the bottom end 56 of the ramp surface 50 and the bottom end 52 of the ramp surface 48 and the top end 58 of the ramp surface 50.

Since each ramp section 44, 46 is the same, the description herein will be limited to the exemplary ramp section 44. A space 60 is defined beneath the top end 54 of the ramp section 44 to define a through passage for a stream of air initiated by operation of the fan 26. The fan 26 is an axial fan which is operable to move about 105 cubic feet of air per minute. A suitable fan is currently available through Comair Rotron of Saugerties, N.Y.

The fan 26 has a squared housing 62 with a bracket 64 that is movable into a slot 66 in the bottom wall 28 of the base section 18. The fan housing 62 is secured in place by bolts 68 on the bracket 64 to which nuts 70 are threaded from underneath the bottom wall 28.

With the fan 26 in its operative position, the rotational axis 72 of a blade 74 on the fan 26 is aligned to be substantially parallel to a tangent to the ramp surface 48 at the free end 76 thereof. The outer wall 40 on the guide section 32 has an undercut 78 that is shaped to conform to the fan 26 to maintain the fan 26 in a desired attitude relative to the guide section 32.

The bottom wall 28 of the base section 18 has an arcuate through opening 80 to allow external air to be drawn by the fan 26 through the wall 28 to be propelled into the display chamber 14. The support legs 30 maintain the bottom wall 28 in an elevated position relative to a surface on which it is mounted to allow external air to be drawn freely through the opening 80. A wire screen 82 having relatively large pores is mounted in the opening 80 and defines a support for a foam filter 84 that prevents passage of dirt and other foreign matter into the chamber 14.

As the fan 26 is operated, the blade 74 rotates in the direction of the arrow 86 so that the fluid advanced thereby moves in a spiral such that the fluid moves downwardly adjacent to the surface 38 and upwardly away from the surface 38. The significance of this will be discussed below.

Figure 6:
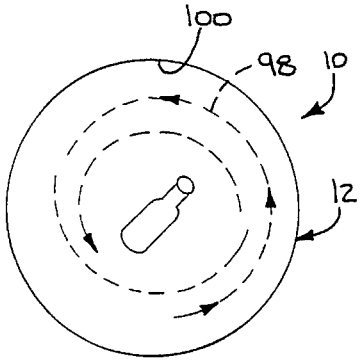
FIG. 6 is a schematic plan view of the inventive display showing the fluid/discrete particle flow pattern.
Figure 5:
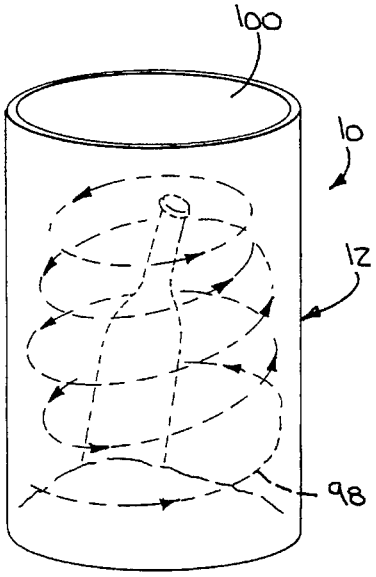
FIG. 5 is a schematic perspective view of the inventive display showing a fluid flow pattern for discrete particles entrained in an operating fluid.
Figure 7:
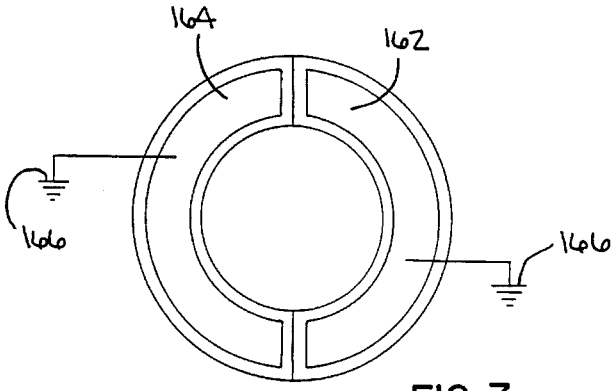
FIG. 7 is a schematic plan view of the display showing a structure for grounding parts thereof to reduce static electricity.

Air is drawn in through a screen 88 at the inlet side 90 of the fan 26 and is exhausted at the outlet side 92 through a screen 94 in a line that is transverse to the central axis 96 of the display 10. The propelled stream of fluid moves along the surface 50 and is guided by the surfaces 36, 38 as it follows the rising contour of the ramp surface 50 until it departs therefrom. As the discrete particles 16 depart from the ramp surface 50, the stream of fluid from the fan 24 gives the discrete particles 16 an additional lifting force so that the particles 16 move in a spiral path as shown in dotted lines 98 in FIGS. 5 and 6. The size of the spiral or vortex pattern is limited by a cylindrical inside surface 100 of the viewing wall 20.

The discrete particles 16 can be made from a number of different materials. For example, they could be made from white paper, plastic chips, or ground styrofoam. More preferably, the discrete particles 16 are made from ground, expanded polystyrene so that they have random shapes and sizes.

According to the invention, the fans 24, 26, in addition to creating a spiral flow pattern for the discrete particles 16, create a cushion of air on which the particles 16 are supported. The smaller, lighter particles 16 elevate to a greater extent in the chamber 14, whereas the larger, heavier particles 16 reside lower and at the intermediate heights.

The cap section 22 prevents the escape of lighter particles 16 from the chamber 14. More particularly, a perforate ring 102 is press fit to the top edge 104 of the viewing wall 20. The ring 102 has a center wall 106 that is in the shape of a snow flake, but which could be any perforate shape. The particles 16 are captured by a fine mesh screen 108 which is fit within a receptacle 110 defined by the ring 102.

With the above arrangement, air flow is permitted through the bottom wall 28, into and through the chamber 14 and through the ring 102 to externally of the display 10. This prevents pressure buildup that might adversely affect the flow for the particles 16.

To cause a more random pattern for the discrete particles 16, deflector means 112, 114 are provided in association with each fan 24, 26. Exemplary deflector means 114 has a body 116 with fingers 118, with there being a space 120 between adjacent fingers 118 to allow through passage of fluid. The fingers 118 have a convexly curved, upper surface 122 for deflecting particles 16 departing from the ramp surface 48 in an upward direction. Some of the particles 16 pass freely through the spaces 120 between adjacent fingers 118. With this arrangement, turbulence is induced into the otherwise smooth spiral flow pattern for the particles 16. This causes a more random distribution of the particles 16 to give a more lifelike quality.

It should be understood that both fans 24, 26 are connected and function in substantially the same manner at diametrically opposite locations on the display 10. The fan 24 draws external air in through an opening 80' in the bottom wall 28 of the base section 18, through a filter 84' and over the ramp surface 48 in the direction of the arrow 124, to complement the action of the fan 26. The deflector means 112 operates in the same manner as the deflector means 114.

Several other aspects and details of the invention will be discussed below. The viewing wall 20 is preferably constructed from a clear plastic so that viewing of the chamber 14 is possible through a full 360°. The viewing wall 20 can be made from plastic or glass, with the former being more economical.

Cutouts 126, 128 are provided in the viewing wall 20 to allow access to the fans 24, 26 without the need to disassemble the viewing wall 20 from the base section 18. This allows the fans 24, 26 to be removed to be cleaned, maintained, or replaced, as need dictates.

An access opening 130 is provided in the center wall 106 to permit the addition of particles to the chamber 14. An aligned opening 132 is provided in the screen 108 and can be blocked by a removable plug 134.

To enhance the appearance of the display 10, a raised center section 34 can be formed to simulate a snow drift. The center section defines a receptacle 136 within which an object, in this case a bottle 138, is situated, to give the appearance that the bottle 138 is embedded in a snow drift. With this arrangement of the bottle 138, the particles 16 swirl thereabout to simulate blizzard conditions. The outer surface of the center section diverges from top to bottom to guide falling particles 16 against the ramp surfaces 48, 50.

To further accentuate the winter scene, an external wrap 140 can be applied to the outer surface 142 of the viewing wall 20 to simulate snow and/or icicles at the top of the viewing wall 20. Above the icicles, the center wall 106 can be adorned by a border 144 thereon that simulates a layer of snow.

At the bottom of the viewing wall 20, an annular skirt 146 is provided to simulate a pile of snow. The skirt 146 is constructed in three joinable sections 148 which cooperatively extend through a full 360°. In addition to the ornamentation provided by the skirt 146, the skirt 146 covers the functional elements on the base section 18 and the cutouts 126, 128 in the viewing wall 20. The section 148, as well as the border 144 and center section 34, can be made by forming plastic or other material in a manner well known to those skilled in the art i.e. by vacuum forming, etc.

An optional light 150 is provided within the bottle 138 or chamber 14 to project outwardly through the viewing wall 20. The light 150 is powered by a source 152.

Figure 2:
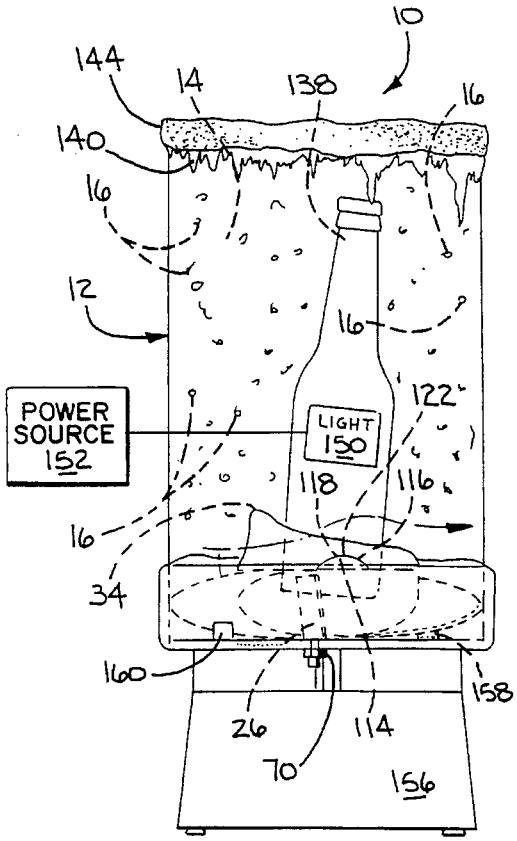
FIG. 2 is a side elevation view of the assembled display on a pedestal-type stand.
Figure 3:
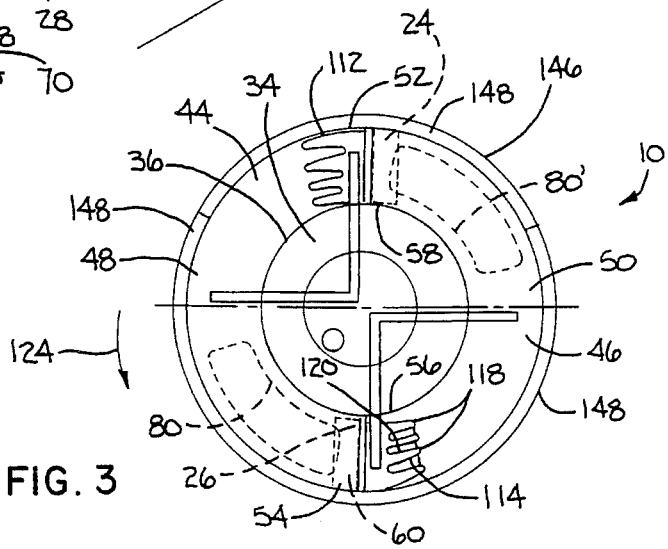
FIG. 3 is a plan view of the display in FIGS. 1 and 2.
Figure 4:
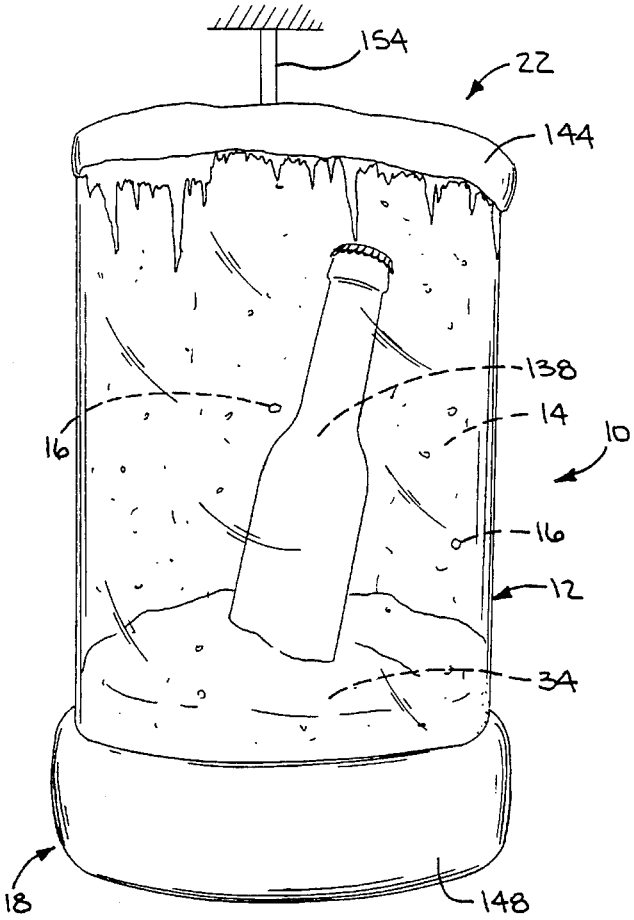
FIG. 4 is an enlarged, perspective view of the assembled inventive display suspended from an overhead support.

The display 10 can be mounted from an overhead bracket 154, as shown in FIG. 4, or upon a pedestal 156, as shown in FIG. 2.

Radially projecting air openings 158, 160 can be provided to augment the supply of incoming air from the openings 80, 80' or can be used in substitution therefor.

A problem that arises with the use of plastic parts is the development of static electricity that might cause the particles 16 to adhere to a part of the display 10. According to the invention, an anti-static spray can be applied internally and/or externally of the display to alleviate this problem. A suitable anti-static spray is available through ACL Incorporated and sold as its "staticide". Other anti-static material is available on the market and would perform the same function.

As an alternative, and in a less preferred form, grounding plates 162, 164 can be attached to the display 10, as to the ramp surfaces 48, 50. The plates 162, 164 can be connected to ground 166 so that there is a continuous dissipation of the static electricity.

As a further alternative, the plastic parts of the display 10 can be made with carbon particles dispersed therein. This makes the plastic conductive to facilitate grounding thereof.

The inventive structure produces a highly visually appealing display. The basic structure produces a dramatic blizzard effect. This effect is enhanced by the use of the deflector means 112, 114. The described direction of rotation for the fans 24, 26 also enhances the flow pattern by causing the particles 16 to be propelled towards the viewing wall 20 so as to be directed upwardly and rebounded into the spiral flow.

The foregoing disclosure of specific embodiments is intended to be illustrative of the broad concepts comprehended by the invention.

We claim:

1. An animated display comprising:

a case defining an internal display chamber that is visible from externally of the case, said case including a peripheral wall bounding the internal display chamber;

a plurality of discrete particles within the display chamber; and means on the case for propelling the discrete particles in an upward continuous circular path around a vertical axis with the particles suspended in a fluid within the display chamber, said propelling means including means in addition to the peripheral wall for changing the direction of movement of the propelled discrete particles by deflecting some of the propelled particles in an axial direction relative to the vertical axis as they move in the circular path.

2. The animated display according to claim 1 wherein the circular path extends around a vertically extending axis.

3. The animated display according to claim 2 wherein the means for propelling the discrete particles includes means for producing a stream of fluid moving in a direction transverse to the vertically extending axis.

4. The animated display according to claim 2 wherein the internal chamber is filled with air and there are means on the case for allowing continuous introduction of air into the display chamber and exhaustion of air from the display chamber as the animated display is operated.

5. The animated display according to claim 1 wherein the peripheral wall has a cylindrical inside surface that bounds the display chamber.

6. The animated display according to claim 1 wherein the means for propelling the discrete particles includes a fan with a rotary blade.

7. The animated display according to claim 1 wherein the discrete particles are made of plastic.

8. The animated display according to claim 1 wherein the discrete particles are made of ground, expanded polystyrene.

9. An animated display comprising:

a case defining an internal display chamber that is visible from externally of the case;

a plurality of discrete particles within the display chamber; and means on the case for propelling the discrete particles in a continuous circular path with the particles suspended in a fluid within the display chamber, wherein the means for propelling the discrete particles includes means for producing a stream of fluid moving in a direction transverse to the vertically extending axis, wherein the means for propelling the discrete particles includes an upwardly facing ramp surface that accumulates discrete particles that fall by gravity in the display chamber, said ramp surface being inclined from horizontal so that discrete particles moving along the ramp surface have a vertical velocity component.

10. The animated display according to claim 9 wherein the ramp surface has an upper free edge at which discrete particles moving along the ramp surface separate from the ramp surface.

11. The animated display according to claim 10 wherein the means for producing a stream of fluid produces a stream of fluid that travels beneath and past the upper free edge of the ramp surface.

12. The animated display according to claim 9 including deflector means for intercepting and redirecting discrete particles moving along the ramp surface.

13. The animated display according to claim 12 wherein the ramp surface has an upper free edge at which discrete particles moving along the ramp surface separate from the ramp surface and the deflector means is located to intercept discrete particles separating from the ramp surface at the upper free edge of the ramp surface.

14. The animated display according to claim 13 wherein the deflector means comprises first and second formed fingers with a space therebetween to allow passage of fluid.

15. An animated display comprising:

a case defining an internal display chamber that is visible from externally of the case;

a plurality of discrete particles within the display chamber; and means on the case for propelling the discrete particles in a continuous circular path with the particles suspended in a fluid within the display chamber, wherein the discrete particles are made of plastic, said display further including means for reducing static electricity in the display chamber to prevent clinging of the discrete particles to the case.

16. An animated display comprising:

a case defining an internal display chamber that is visible from externally of the case;

a plurality of discrete particles within the display chamber; and means on the case for propelling the discrete particles in a continuous circular path with the particles suspended in a fluid within the display chamber, wherein the circular path extends around a vertically extending axis, wherein the means for propelling the discrete particles includes first and second means for producing separate streams of fluid each moving in a direction transverse to the vertically extending axis and first and second upwardly facing spiral ramp surfaces that accumulate discrete particles that fall by gravity in the display chamber.

17. An animated display comprising:

a case defining an internal display chamber that is visible from externally of the case;

a plurality of discrete particles within said chamber; and means on the case for propelling the discrete particles to move in a continuous spiral path about a vertical axis suspended in a fluid in the display chamber, said propelling means including at least one deflector for intercepting at least part of the discrete particles moving in the continuous spiral path and deflecting the at least part of the discrete particles axially upwardly into the discrete particles moving in the continuous spiral path.

18. The animated display according to claim 17 wherein the continuous path simulates the appearance of a vortex.

19. The animated display according to claim 17 wherein the case includes a wall with a cylindrical inside surface with a vertical axis and the discrete particles move in the continuous path about the vertical axis.

20. The animated display according to claim 18 including an object within the internal chamber and wherein the discrete particles move around the object to give the appearance that the object is in a snowstorm.

21. The mated display according to claim 20 including means within the internal chamber for simulating a snow bank within which the object is placed.

22. An animated display comprising:

a case defining an internal display chamber that is visible from externally of the case;

a plurality of discrete particles within said chamber; and means on the case for propelling the discrete particles to move in a continuous path around an axis suspended in a fluid in the display chamber, wherein the continuous path simulates the appearance of a vortex, said display including an object with the internal chamber, said discrete particles moving around the object to give the appearance that the object is in a snowstorm, said display further including means within the internal chamber for simulating a snow bank within which the object is placed, said propelling means being at least partially in radially overlapping relationship with the axially extending space wherein the means for simulating a snow bank defines a curved outer surface that has an axial extent to guide discrete particles therearound in a circular path in an axially extending space between the curved outer surface and the case.

23. An animated display comprising:

a case defining an internal display chamber that is visible from externally of the case;

a plurality of discrete particles within said chamber; and means on the case for propelling the discrete particles to move in a continuous path suspended in a fluid in the display chamber, wherein the case includes a wall with a cylindrical inside surface with a vertical axis and the discrete particles move in the continuous path about the vertical axis, wherein the means for propelling the discrete particles includes a fan with a blade that rotates about an axis that is transverse to the vertical axis and the fan blade is rotated in a direction so that fluid moved by the fan blade is directed downwardly closer to the inside wall surface than where the fluid is directed upwardly by the fan blade.

24. The animated display according to claim 23 including means on the exterior of the case for simulating at least one of ice and snow.

* * * * *